United States Patent [19]

Jou et al.

[11] Patent Number: 4,492,945

[45] Date of Patent: Jan. 8, 1985

[54] SAFETY SOCKET WITH EASY FUSE REPLACEMENT DEVICE

[76] Inventors: W. F. Jou, 8, La. 18, Pao Yuan Rd., Sec. 2, Hsintien City, Taipei Hsien; C. N. Chen, 4th Floor, No. 17, La. 411, Neihu Rd., Sec. 1, Taipei, both of Taiwan

[21] Appl. No.: 420,659

[22] Filed: Sep. 21, 1982

[51] Int. Cl.[3] ..... H01H 85/14

[52] U.S. Cl. ..... 337/229; 337/230; 337/237

[58] Field of Search ..... 337/142, 144, 149, 186, 337/213, 228, 229, 230, 237, 283, 289

[56] References Cited

U.S. PATENT DOCUMENTS

| | | | |
|---|---|---|---|
| 2,234,024 | 3/1941 | Cree et al. | 337/259 |
| 2,898,424 | 8/1959 | Vischer | 337/259 |
| 4,196,409 | 4/1980 | Juba | 337/259 |

*Primary Examiner*—George Harris

*Attorney, Agent, or Firm*—Karl W. Flocks; Sheridan Neimark; A. Fred Starobin

[57] ABSTRACT

A safety socket with easy fuse replacement device, specifically it covers a socket body and a cylinder used to house a number of protection fuses, the cylinder may be inserted into the annular guidance as provided on the socket body and used to shroud the cylinder whose center abound in insertion holes, characterized in that the center of the insertion hole is provided with a push-on switch such that it may be pressed to conduction once the socket is inserted into the insertion hole, in the event that a fuse is burnt and broken due to overloading, by giving a grip-turn to the cylinder the conserved fuse will replace the function of the broken fuse, and in this manner time and labor are saved, in the meantime, dangers due to replacement of a fuse and a fuse in use are eliminated.

3 Claims, 4 Drawing Figures

SAFETY SOCKET WITH EASY FUSE REPLACEMENT DEVICE

SUMMARY OF THE INVENTION

The present invention provides for a simple-to-use safety socket with easy fuse replacement device, comprising a socket body and a cylinder the interior of which is supplied with annularly arranged fill-in holes for a good number of fuses as reserved spare parts, the cylinder may be inserted into the annularly guidance as provided on the socket body and to shroud up those cylinders containing insertion holes as provided in the socket body, characteristic in that in the midst of the insertion hole there is provided a push-on switch that will function to cut off the U piece serving to give hold to the socket conductor in the cylinder from conduction, whereas that once the socket is inserted into the insertion hole, it is made possible to press in the push-on switch simultaneously so that the U piece will be driven into conduction, and that where the active fuse got broken out of overloading, all that has to be done is to thumb-turn the cylinder to turn the reserved fuse to working condition in lieu of the damaged one, thus achieving saving in time and labour in respect of replacing a fuse in operation and in eliminating dangers likely to happen in the use of a fuse in connection with any electrical appliance that is put to use therewith.

Few would protest the fact that in using conventional sockets it is a fact that the retainer meant to hold a plug, as provided in the socket, is in direct link with the power line, so to speck, the socket as a whole, is in conduction even an external plug has not been plugged into it, the very fact that most sockets are fixed to the foot of a wall close to the ground floor is even more dangerous since quite a number of children would insert coins or metal wires or even their own little fingers into the plug-in slits out of curiosity or to make funs for themselves, still worse is that most families would prefer to attache extended sockets or multi-directional sockets to the prime socket where power access is not sufficient, that explains why and is a common cause for frequent fuse melting to breakaway failures, that is quite an inconvenience indeed because replacements of fuse is not an easy or sure job for non-professionals, electric shock can happen far too easily where skilled care is not taken in advance, as the fact stands, most housewives dread it very much to do such things as a replacement of fuse.

So here comes our new invention, titled safety socket with easy fuse replacement device, offered in veie of all the inconveniences with conventional sockets such as those cited above, characteristic in that both plug-in slits and reeds will remain non-conductive when not in service, thus greatly enhances the safety feature to the extent that no electric shock would turn up even if naughty or innocent children should insert coins or other metal pieces or wires into the plug-in slits of a socket structured under the present invention.

Still another objective of the present invention it is to provide a simple-to-use safety socket with easy fuse replacement device, specifically it means one socket reserved with a number of protective fuses within, so that one reserved fuse may be chosen to replace a failure without having to trouble with other elaborate repairings, in addition, the socket can be taken down without any tool when all the reserved fuses are used up, to be stored in full, and most remarkably, supply of used up fuses can be done free from contact or exposure to the power.

DETAILED DESCRIPTION

Figure 1:
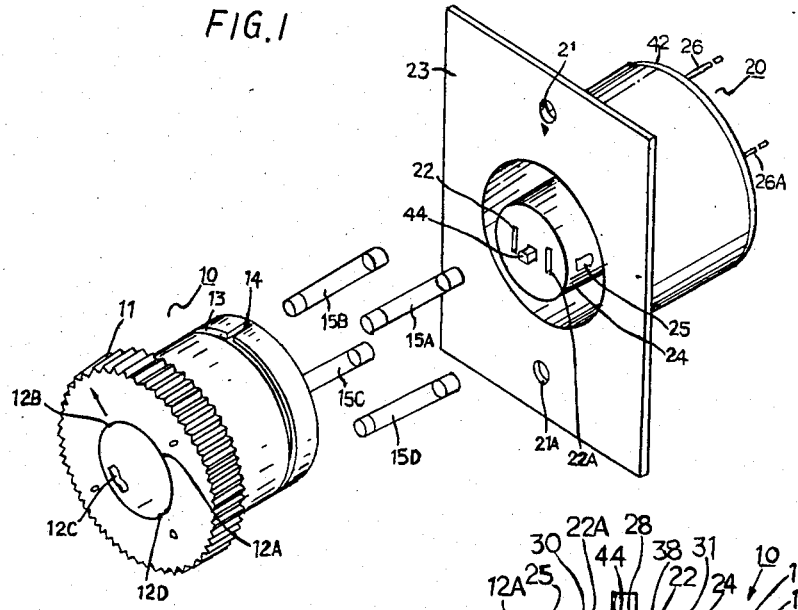
FIG. 1 is a three-dimensional analytical view of the present invention titled Safety socket with easy fuse replacement device.
Figure 3:
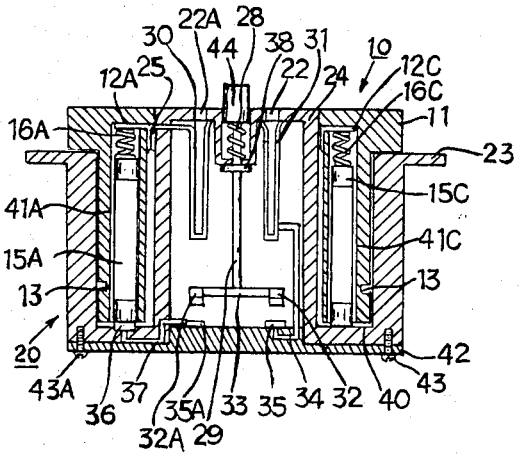
FIG. 3 is a top view perspective of the illustration as given in FIG. 2 along section line A—A.
Figure 2:
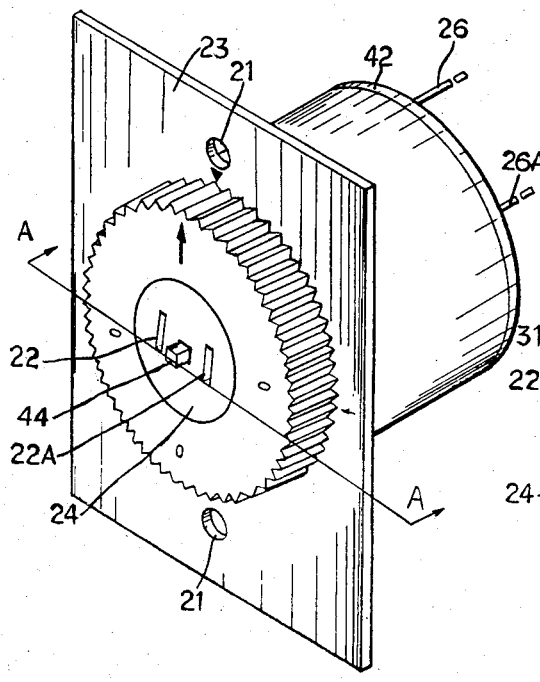
FIG. 2 is a perspective profile of the Safety socket with easy fuse replacement device that is the subject of the present invention.
Figure 4:
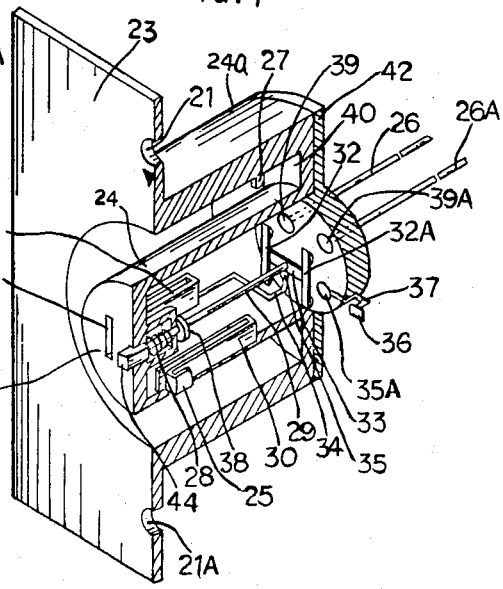
FIG. 4 is a three-dimensional structural view of the socket body as covered by the present invention.

Referring to FIG. 1 through FIG. 4 it is seen that the present invention covering a Safety socket with easy fuse replacement device consists of a socket body 20 from the center of the fix board 23 thereof there extends a cylinder **24*a* with orifices provided in front, there is, in addition, extended another socket cylinder 24 with orifices on the end edge from the base of the cylinder 24*a*, such that an annular guidance 40 is formed between cylinder 24 and cylinder 24*a* to serve to house in a hollow cylinder 10 used to contain fuse-filling holes 41A, 41B, 41C, and 41D, the front end of the hollow cylinder 10 is attached to a swivel gear 11 lying outside the fix board 23, the swivel gear 11 is treated with saw-tooth formations on the periphery to facilitate manual manipulation. The filling holes 41A, 41B, 41C, 41D in the hollow cylinder 10 are each complete with arc conductors 12A, 12B, 12C, 12D leading to the inner walls of the cylinder 10 and with a spring 16A, 16B, 16C, 16D respectively, as seen from FIG. 1 and FIG. 3, the idea is that once fuses 15A, 15B, 15C, 15D are loaded respectively in filling holes 41A, 41B, 41C, 41D, the cylinder 10 can be combined with the socket body 20 by dint of the guidances 13, 14 on the outer wall of cylinder 10 and the nose 27 as provided on the outer wall of the annular guidance 40 for the socket body 20, as illustrated in FIG. 4, the setting for combination goes like this, the nose 27 goes past guidance 14 to drive rotor 11 into rotation in clockwise directions, so that nose 27 will move forward along guidance 13 till the arc conductor 25 on the periphery of column 24 turns to fall into the arc conductor 12A in the inner wall of cylinder 10 to a secured engagement, the result is that the bottom end of fuse 15A will join with that conductor 36 as disposed in advance in the annular guidance 40, thus accomplishing the replacement of a failure fuse. Where the socket body 20 is to be installed in a wall, then the metal joints 39 and 39A that are provided on the base lid 42 shall be connected to power line 26 and 26A firstly, the next step is to fix the base lid 42 to the bottom of cylinder 24*a* in the socket body 20 with screws 43 and 43A, there are provided with fixing holes 21 and 21A on the front side of the fix board 23 to facilitate bolting of screws onto the walls, reference at this point can be made to FIG. 3 and FIG. 4, there are also provided with insertion slits 22 and 22A for the insertion of plugs at the front end of cylinder 24, the interior of slits 22 and 22A are all complete with U shape clips 31 and 30, clip 31 connected to a joint 35 on the base lid 42 via a conductor wire 34, whereas clip 30 extends outside of cylinder 24 as an arc shape conductor 25 and set at link with conductor 36 by the medium of fuse 15A, conductor 36 set to connection with joint 35A through conductor 37. Referring now to FIG. 3 and FIG. 4 it is seen that the front side of cylinder 24 that lies between slits 22 and 22A is provided with a push-on witch 44 in middle, the terminal end of the push-botton of the push-on switch 44 is attached with a shaft bar 29, the bottom of the shaft bar 29 being provided with an insulation piece 33, both ends of the insulation piece 33 complete with a conducting piecelet 32 and 32A respectively, the present invention that is the subject socket, when set at working state, that is, when the conducting bits of the external plug are fully inserted into slits 22 and 22A, will be in a position such that the external plug will also be thrusting against the push-on button of the push-on switch 44, in the meantime the spring 28 will likewise be compressed to set the shaft bar 29 depressed, so that the conducting bit 32 as provided on the front tip of the shaft bar 29 will set joint into conduction altogether, the other conducting bit 32A, on the other hand, will set joint 39A into conduction with joint 35A, the result is that power will pass on direct to U shape clip 30 and 31 and concurrently set the externally imposed plug at conduction as access to the plug is achieved by way of conducting bits 32 and 32A; now if and whenever the plug is withdrawn from insertion slits 22 and 22A, then push-on switch 44 will react to carry shaft bar 39 owing to the recovery of spring 38 so that conduction bits 32 and 32A will instantly brake out power with respect to joint points 39 and 39A, since that a fix member 38 is provided on the shaft bar 39, the push-on switch 44 will remain sturdily in position all the times, so to speck, in off-duty times the U shape clip 31 in the slits is not in a conducting state, and therefore, electric shocks and incidents therewith are avoided despite naughty and innocent children may put metal threads or other conducting materials into the slits whilst the socket claimed hereunder is not in active services, still another characteristic point of the present invention lies in that a number of protective fuses 15A, 15B, 15C, 15D are furnished in the cylinder 10, they serve as reserved spare parts to come to service in lieu of a failure fuse, that is, the active fuse that turns broken as a result of overloading use, one such reserve fuse for one failure case, to accomplish the replacement, just turn the swivel gear 11 as provided in front of the rotation cylinder 10 in clockwise directions with human thumb finger, you can be assured that a replacement of a reserved fuse to take the place of the failure fuse has been fulfilled, that is, that the conducting piece on top of the new fuse has regained for the socket a conducting status with the arc conductor 25 as covered in the same socket, on hearing a noise that occurs when the arc conductor 12 falls into the arc conductor 25 and identify it accordingly. In the swivel knob 11 there is provided with an arrow indicator to indicate as to the current status of fuse supply in the cylinder 10, on ascertaining the arrow has run for a full cycle, it means that fuses 15A, 15B, 15C and 15D have all been used up, to supply new stock of fuses, just turn the swivel knob 11 slightly to the right to reach the situation wherein the nose 27 of the socket body 20 will face straight to the guidance groove 14 on the periphery of the cylinder 10, whereupon the cylinder 10 will be extruded out by the recovery force due to internal springs 16A, 16B, 16C and 16D, now just take out the cylinder 10 to fill in with new fuse stocks and then put it back into the socket body 20** for further service, this way it will save you a lot of fuse replacement time and labour, and also, incidents due to electric shocks can be avoided once for all where subject sockets are used.

For the subject socket an arrow indication is provided on the fix board 28 corresponding to where the arc conductor 25 is situated to facilitate fuse replacement procedures, in addition, on the swivel knob 11 at locations aligned to each fuse conduction pieces 12A, 12B, 12C, 12D there is marked sign supplemented respectively to secure a correct engagement of the conducting member 12 on top of a replacing fuse with respect to the arc conductor 25 by aligning marked signs on the swivel knob to the arrow-identifiable fix board 23 whilst a failure fuse has to be replaced to keep the socket in serviceable conditions.

By virtue of the structure schemed for the present invention titled Safety socket with easy fuse replacement device as disclosed thus far it is clear that the present invention is much more convenient, safe, and efficient than conventional sockets, so the present invention is deemed a really worthwhile piece of invention indeed.

We claim:

1. A safety socket with easy fuse replacement device, comprising: a socket body, a cylinder projecting from the center of the fix board for the socket body with orificed fronts, a socket cylinder complete with frontal insertion slits as extended from the base of the cylinder, whose tail is apertured, an annular guidance to facilitate the suitable introduction of a hollow cylinder as formed between above mentioned cylinders, a first clip and a second clip as provided paralled and aligned to above mentioned slits in the socket cylinder, the second clip extended exposed outside the socket cylinder to form an arc conductor;

a hollow cylinder whose frontal end can be suitably sleeved over the annular guidance as provided in the socket body, the tail end of the hollow cylinder annexed with a swivel knob whose interior is equidistantly spaced to permit housing of a number of fuse containing holes, in each fuse containing hole there are loaded respectively conduction pieces that will extend outside of the hollow cylinder and effect apt engagement with arc conductor, to be executed by taking the dimension of the two arc conductors led from the two clips into account;

a base lid as mounted to the bottom of the cylinder body, on which lid there are provided two sets of joint contacts, the upper joint point for each set being connected to the power line by the medium of conducting wires, whereas the lower joint point for each set are each connected to the first and the second clips respectively by means of conducting bodies and the active fuse;

a push-on switch provided between the two slit holes of the socket cylinder, comprising a push-on button exposed outside the fix board and a shaft bar that is incorporated integrally to the push-on button, the front end of the shaft bar being furnished with an insulation piece, both ends of the insulation piece provided with conducting bits leading to said two sets of joint contacts going to the power source.

2. The safety socket with easy replacement device according to claim 1, characteristic in that whilst an external plug is inserted into the slits of the socket, the push-on switch will react to drive on the push-on switch simultaneously and in the meantime serve to displace the shaft bar inwards so as to set the two conducting pieces as provided in front of the shaft bar into close-up contact with the two sets of joint contacts as provided on the base lid of the socket so that the two clips will become in conduction with the power source; that on the shaft bar there are sleeved thereto a spring and a fixer, to serve the purpose that once the plug is withdrawn, the push-on switch will recover itself automatically owing to the retention of the recovery spring in conjunction with the fix-stabilization effect of the fixer because of the vanishing of tensions heretofore borne on the push-on button, the power source is thereby cut out from the two clips, the clips are therefore in non-conducting states.

3. The safety socket with easy fuse replacement device according to claim 1, characteristic in that markings are provided on the fix board at locations corresponding to the arc conductor as extended from the clips, and in addition that like markings are likewise provided on the swivel knob with respect to each fuse conducting piece so as to facilitate a correct positional engagement in the replacement procedure of a fuse.

* * * * *